US007011268B2

(12) United States Patent
Achelpohl et al.

(10) Patent No.: US 7,011,268 B2
(45) Date of Patent: Mar. 14, 2006

(54) METHOD AND DEVICE FOR CUTTING THROUGH A RUNNING WEB OF MATERIAL AND FOR FIXING THE START OF THE FOLLOWING WEB SECTION ON A CORE

(75) Inventors: Fritz Achelpohl, Lienen (DE); Gottlieb Looser, deceased, late of Balzers (CH); by Jris Looser, legal representative, Bad Ragaz (CH)

(73) Assignee: Windmoeller & Hoelscher KG, Lengerich/Westf. (DE)

( * ) Notice: Subject to any disclaimer, the term of this patent is extended or adjusted under 35 U.S.C. 154(b) by 0 days.

(21) Appl. No.: 10/343,823

(22) PCT Filed: Jul. 31, 2001

(86) PCT No.: PCT/EP01/08869

§ 371 (c)(1),
(2), (4) Date: Oct. 3, 2003

(87) PCT Pub. No.: WO02/12101

PCT Pub. Date: Feb. 14, 2002

(65) Prior Publication Data

US 2004/0046081 A1 Mar. 11, 2004

(30) Foreign Application Priority Data

Aug. 7, 2000 (DE) ..... 100 38 423
Oct. 31, 2000 (CH) ..... 2125/00
Nov. 29, 2000 (DE) ..... 100 59 338

(51) Int. Cl.
*B65H 75/28* (2006.01)

(52) U.S. Cl. ..... 242/532.2; 242/527.1; 242/532.7; 242/533.2; 242/548.4

(58) Field of Classification Search ..... 242/532.2, 242/532.7, 532, 527.1, 548.4, 527.2, 533, 242/533.2, 533.3
See application file for complete search history.

(56) References Cited

U.S. PATENT DOCUMENTS 3,505,150 A * 4/1970 Andersson ..... 242/527.1
3,549,097 A * 12/1970 Seigh ..... 242/527.1
3,552,670 A * 1/1971 Herman ..... 242/527.1
3,910,518 A * 10/1975 Yamaguchi et al. ..... 242/527.1
4,339,092 A * 7/1982 Benoy et al. ..... 242/527.1
4,444,362 A * 4/1984 Karr ..... 242/532.2
4,445,646 A * 5/1984 Karr et al. ..... 242/532.2
4,693,157 A 9/1987 Looser ..... 83/431

(Continued)

FOREIGN PATENT DOCUMENTS

DE 1 274 853 8/1968

(Continued)

*Primary Examiner*—William A. Rivera
(74) *Attorney, Agent, or Firm*—Jacobson Holman PLLC

(57) ABSTRACT

For the winding of a material web on a driven winding roll, it is cut through after the completed winding of a winding roll and the start of the following web is fastened on a winding core. The web is fed in the winding roll via a guide device, preferably consisting of a winding roller, and, after being cut through in a guide channel laid around a winding tube. In order to be able to wind the web with alternating outer sides into a winding roll, the web is fed, according to the desired outer side, from the left or from the right on winding in the winding tube. The winding tube is driven with a corresponding one of two opposite directions of rotation.

24 Claims, 14 Drawing Sheets

U.S. PATENT DOCUMENTS

| | | | | | |
|---|---|---|---|---|---|
| 4,695,004 | A | * | 9/1987 | Grossmann et al. | 242/532.2 |
| 5,249,758 | A | * | 10/1993 | Muller et al. | 242/533.3 |
| 5,954,291 | A | * | 9/1999 | Meinecke et al. | 242/533.3 |
| 6,179,241 | B1 | * | 1/2001 | Ba Dour, Jr. et al. | 242/527.1 |
| 6,305,635 | B1 | * | 10/2001 | Looser | 242/532.2 |
| 6,474,589 | B1 | * | 11/2002 | Enwald et al. | 242/532.2 |

FOREIGN PATENT DOCUMENTS

| | | | |
|---|---|---|---|
| DE | 40 06 412 | * | 9/1991 |
| EP | 0 017 277 | | 10/1980 |
| EP | 0 394 197 | | 10/1990 |
| WO | 99/06313 | | 2/1999 |

* cited by examiner

METHOD AND DEVICE FOR CUTTING THROUGH A RUNNING WEB OF MATERIAL AND FOR FIXING THE START OF THE FOLLOWING WEB SECTION ON A CORE

This is a nationalization of PCT/EP01/08869 filed Jul. 31, 2001 and published in German.

BACKGROUND OF THE INVENTION

1. Field of the Invention

The invention relates to a process for cutting through a material web running into a driven winding roll and for the fastening of the start of the following web on a winding core or a winding tube in which the web is guided into the winding roll via a guide device consisting preferably of a winding roller and after being cut through is laid around the winding tube in a guide channel. The present invention also relates to an apparatus for carrying out this process.

2. Description of the Related Art

Continuously produced material webs, e.g., single-layer webs of thermoplastic plastic or flat hose webs made in a blown foil facility, must be wound into winding rolls for storage and handling. In so doing, the current web running continuously into a winding roll must be cut through after the completed winding of a winding roll and the start of the following web must be fastened for initial winding onto a winding core or a winding tube in order to be able to continue the winding process of the continuously fed web without disturbance or redirection.

It is a known practice to wind the start of a web to be wound into a winding roll onto a winding tube which is provided with an adhesive coat for fastening the start of the web.

In order to avoid this adhesive coat to be applied with an additional expense, apparatuses for the adhesive-free initial winding of webs onto winding tubes are also known. A known apparatus for the adhesive-free initial winding of a start of a web onto a winding core or winding tube consists of a winding tube positioned on a guide roller provided with vacuum holes in its casing, onto which winding tube, after cutting through the web, the start of the web formed thereby is wound due to the fact that a suction box is run into the roller gap between the guide roller and the winding tube, said suction box being provided on an elongated edge with a knife cutting through the web and adjacent to the knife with a wall curved in the form of a shell, said wall forming, with an area of the circumferential surface of the winding tube, a channel curved in the form of a shell, where on the front end of said channel, in the area of the roller gap, air is suctioned through the suction box in such a manner that the start of the web is suctioned into the guide channel and thereby is held fast on the winding tube, that the start of the web runs into the gap between the guide roller and the winding tube in which it is covered by the following web so that the start of the web is held fast on the winding tube after one winding.

A particular problem in the initial winding of winding cores or winding tubes with a start of a web consists, however, of the fact that the webs to be wound into winding rolls are asymmetric, which means, that they have sides with different properties. According to the further processing of the webs to be wound into winding rolls, it is thus desired that one or the other side lies on the outside of the winding roll. In order to be able to produce winding rolls on which the webs are wound with alternating outer sides, therefore one time with one side lying outside and another time with the other side lying outside, it is necessary to drive the guide roller and the winding core or the winding tube in opposite directions of rotation, which makes it necessary to feed the start of the web formed by separation of the web from the guide roller to the winding tube, according to the direction of rotation, from directions opposite to one another. A feed of this type of the start of the web to the winding tube from directions opposite to one another is not possible in the known apparatus.

SUMMARY OF THE INVENTION

It is thus the objective of the invention to provide a process of the type stated initially which makes it possible to feed the start of the web to be wound into a winding roll to a winding core or a winding tube according to the direction of rotation approximately tangentially in such a manner that the web optionally can be wound into a winding roll with one side or the other lying on the outside.

According to the present invention this objective is realized in a process and an apparatus of the type specified herein.

A first apparatus for carrying out the process with a guide device guiding the web into the winding roll, with a knife cutting through the web, and with means for redirecting the start of the web from the guide device to the driven winding tube and with a guide channel for laying the web around the winding tube is distinguished according to the present invention by the fact that the guide device, for winding of the web with alternating outer sides onto the winding tube, and the winding tube or the winding core can be driven in directions of conveyance opposite to one another. According to this first form of embodiment of the apparatus according to the present invention it is thus only necessary to feed the web with one or the other side lying on the outside of the guide device, preferably a guide roller, with reversal of the direction of conveyance or rotation, so that the web is wound, with one or the other of side lying on the outside, onto the winding core or the winding tube. In so doing, the winding core or the winding tube is to be provided, in both directions of rotation starting from the point of introduction of the start of the web, with guide channels which lay the start of the web around the winding core or the winding tube in such a manner that, after one winding, it is held fast by the web coming in and covering it.

According to a preferred form of embodiment it is provided that the guide device consists of a driven vacuum roller with a separating knife which can be run out of a gap running axially in the casing and on both sides of the gap of pivotably disposed cover shells which lead the start of the web lifted up from the jacket cylinder, according to the running direction of the web, on the left or on the right around the guide channel. Therefore, in order to be able to wind a web into a winding roll with the desired side lying on the outside, it is only necessary to release the web with the desired side to the vacuum roller and then to initially wind the web in the left or right direction onto the, winding core or the winding tube and subsequently to complete winding.

According to a further development of the invention it is provided that the winding tube is enclosed concentrically by a cylindrical housing forming the guide channel consisting of its annular space, said housing being provided with an axial intake gap for the start of the web.

Expediently the cylindrical housing consists of two pivotably mounted housing shells which in the pivoted-out state release the winding tube. In this way the winding tube can be introduced into the cylindrical housing simply and released by it once again.

The winding tube itself is provided in a known manner with a drive mechanism so that it rotates with the same circumferential speed as the guide roller.

According to an additional preferred form of embodiment, for which independent protection is claimed as apparatus for the redirection of the front end of the material web, it is provided that the cover shells which can be pivoted out consist of a comb-like grid whose fingers, which run freely in the circumferential toward the gap, penetrate, in the pivoted-out state, fingers, disposed with an appropriate offset, which form the edge area of the intake gap of the housing. Penetrating one another in the, manner of a comb, the fingers of the front edges of the cover shells which can be pivoted out and the front edges of the cylindrical housing on both sides of the intake gap lift the start of the web, as it passes, from the guide roller and lead it into the guide channel consisting of an annular space so that the start of the web is lead around the winding tube until it is covered and held fast by the following web.

According to an additional preferred form of embodiment it is provided that, for displacing the intake gap, the housing is mounted pivotably around the central axis of the winding tube. By appropriate pivoting of the housing, either one or the other edge bordering the intake gap of the housing, said edge preferably being formed by fingers disposed in the manner of a grid, can be aligned to the guide roller or the cover shells currently pivoted out from it in such a manner that the start of the web is lifted from the guide roller and led into the guide channel encircling it for looping around the winding tube.

Expediently a pivoting drive mechanism is provided for the housing shells through which they can be pivoted between their open and their closed position. The pivoting drive mechanism can consists of linking arms hingedly connected at one end to the housing shells, where, on the other end of the linking arms hingedly connected to one another, a pneumatic cylinder is hingedly connected.

In order to improve the laying of the start of the web in the guide channel around the tube, each of the housing shells can be provided at a suitable point with vacuum nozzles. The air suctioned by the vacuum nozzles supports the laying of the start of the web around the winding tube and the running of the start of the web into the wedge it forms with the following web.

According to another form of embodiment, it is provided that the housing shells are provided with blast air nozzles which blow blast air into the guide channel approximately tangentially in the running direction of the fed start of the web and lead the end of the previous web stretched around the winding tube until it is held fast by the covering web. The blast air avoids problems which can arise with a vacuum due to the fact that the web is stopped at the vacuum nozzles.

The drive mechanisms pivoting the cover shells out from the guide cylinder can consist of pneumatic cylinders.

According to an inventive extension for which independent protection is claimed as apparatus for the separation of a running web by a cut running transversely, it is provided that the knife consists of individual knives fastened at equal intervals on a knife-carrying bar and that the knife-carrying bar is guided in axial guides of the roller in such a manner that it runs the knives out radially, moves them in the axial direction, and runs them in radially once again., In so doing, in order to insure a clean cut, the axial movement of the knives in their run-out state must be as large as the distance of the knives from one another.

Expediently the knife-carrying bar is provided in the area of its ends with pairs of rollers which run in trapezoidal guides of the guide roller.

However, if the knives, in the execution of the separating cut, are guided parallel to the axis of the knife cylinder, disturbances of the cut can occur if accumulations of material are present in the web to be cut. Accumulations of material of this type can result in webs of plastic foils, for example, at thick points or folding edges of side folds. In webs of any material, accumulations of material form, for the knives, something like shock absorbers which prevent a clean execution of the cut. In order to be able to also execute a clean separating cut when the knives hit accumulations of material in cutting the web, it is provided in an additional development of the invention that the radial and axial movements of the knives are superimposed on one another. This superimposition leads to the knives executing, during cutting, a movement in the plane of the web to be cut and in addition a movement superimposed on this, said movement being perpendicular to the plane. Since therefore the knives execute cutting movements in the plane of the web arid transversely to it, a clean cut is insured even when the knives hit accumulations of material.

Expediently the knife-carrying bar is guided in curved guides, e.g., guides in the form of a circular arc, of the vacuum and knife cylinder.

According to another development it is provided that the knife-carrying bar is mounted on parallel linking arms provided with a pivoting drive mechanism, said linking arms pivoting on a path in the form of a circular arc.

The invention also relates in particular to the winding of continuously running material webs, preferably foil webs on the basis of synthetic or semi-synthetic polymers, onto a series of winding tubes with the aid of a winding apparatus which has a winding roller, at least one deflection roller, and at least one separating device.

For continuous operation it is necessary that the replacement of the completely wound tubes with fresh tubes occurs without interruption of the advance of the material web, often running at high speeds of several hundred meters per minutes. Such material webs are, for example, ejected by continuously operating foil-producing or/and foil-coating machines and must accordingly be wound continuously onto a series of foil windings. For this purpose, various systems are known, see, for example, EP 0 017 277 (U.S. Pat. No. 4,191,341), U.S. Pat. No. 4,693,157, and EP 0 394 197 (U.S. Pat. No. 4,852,820).

The initial winding of the empty tubes requires a reliable connection of the tube to the front end of the new section of the material web, said end being formed, together with the back end of the preceding section of the web running off onto the full winding, on transverse separation of the web. This is no trivial objective and causes problems because the process is very rapid and must be done with great reliability. For this purpose, various methods are known, for example, the laying on and gluing of the foil web on plastic areas on the winding tube, the adhesive-free electrostatic laying on, and the adhesive-free laying on with the aid of a compressed air stream.

For this purpose, a process and an apparatus was described by the inventor in WO 9906313, in which the initial winding is achieved with an opening in the form of a slot extending over the width of the web with a vacuum flow is the form of an arc which causes the required contact of the front end of the new section of the web with the fresh winding tube and makes possible an adhesive-free connection of the foil web with the winding tube.

This known apparatus, however, cannot be used without additional measures for winders in which a given material web can optionally be guided clockwise and counterclockwise, i.e., "bidirectionally" onto the winding roller. A winder which makes possible such as bidirectional winding is needed, in particular, for the winding of foil webs which have a different composition on each side, e.g., only one-sided or coated differently on each side. According to the type of use and/or further processing, the consumers wish that either one side or the other lies on the outer side of the foil winding.

It is thus an additional objective of the invention to specify a bidirectional winding process and suitable apparatus for carrying this process out where the initial winding can also be realized in principle with the vacuum flow method known from WO 9906313.

According to an additional form of embodiment of the invention this objective is realized by a web-winding process, i.e., by a process for initial winding of a continuously running material web onto a series of winding tubes by means of a winding apparatus which has a winding roller, at least one deflection roller, and at least one separating device. Therein the running material web's front end formed on actuation of the separating apparatus is initially wound on the winding tube by a vacuum flow. For operation according to the invention of the winding apparatus as bidirectional winder, for the initial winding of each winding tube, a bell-shaped cover enclosing this winding tube is used, said bell-shaped cover being formed of elongated shells which are movable connected to one another for closing and opening of the bell-shaped cover. Each of the shells has, near its movable end, a vacuum slot extending at least approximately over the length of the winding tube and at any time only one of the two vacuum slots, preferably the vacuum slot lying downstream in the direction of rotation R of the winding roller is actuated for winding. The at least one separating device is disposed in the interior of the winding roller.

Disposed in the interior of a winding roller, such a separating device, which makes possible smooth and reliable web separation even at high operating speeds of several hundred meters per minute, typically in the range up to approximately 10 m/sec, has previously not been known as far as the inventor knows.

Thus, in a second form of embodiment, the invention relates to a web-separating apparatus, i.e., a separating apparatus for use in a web-separating apparatus of the type just described where the separating device is disposed in the interior of the winding roller at a slot in the casing of the winding roller extending over its operating width and has a plurality of pointed separating elements which are connected to one another in their movement, said pointed separating elements for effecting the separating process being formed movably outwards in the radial direction through the casing of the winding roller and at least approximately parallel to the axis of the winding roller in the axial direction, where the length of the movement of each separating element in the axial direction is chosen so that the material web is completely separated transversely. With such a separating apparatus a smooth and reliable transverse separation of the web even at running speeds of the web of up to approximately 10 m/sec, or under certain circumstances even more, is possible.

Web-separating apparatus with a plurality of pointed separating elements are known in themselves, e.g., from the aforementioned patent specification U.S. Pat. No. 4,852,820, but do not affect the separation process by a two-dimensional movement but rather only by a radial movement.

The forming described there of the points and cutting edges of preferred separating elements is, however, also suitable for the present invention, on account of which reference is taken to the specification just mentioned.

According to a third form of embodiment the invention relates to a web winder, that is, an apparatus for the initial winding of a continuously running material web onto a series of winding tubes with a winding roller, at least one deflection roller, at least one separating device, and a device to wind the material web's front end, formed on actuation of the separating device, onto the winding tube by a vacuum flow. The winding apparatus suitable for bidirectional operation according to the invention has a bell-shaped cover formed by two elongated shells and enclosing the winding tube onto which winding is currently to occur where each of the shells has, near its free, i.e., not connected to the other shell, end, a vacuum slot extending at least approximately over the length of the winding tube. The bell-shaped cover furthermore has devices in order to actuate one of the two vacuum slots, preferably the vacuum slot currently lying downstream in the direction of rotation of the winding roller, for initial winding. The separating device lies in the interior of the winding roller.

The invention is suitable in principle for the continuous winding of webs of different materials such as paper, textile material, and metal foils but is used in particular in the course of production and/or processing of endless foils or bands on the basis of synthetic or semi-synthetic polymers such as the known endless foil webs on the basis of cellulose and cellulose derivatives, polyalkylenes, polyesters, polyethers, polyurethanes, polyamides, and the like, in particular if these foils have a different surface composition on their two sides.

Expediently the material web is held in contact with the winding roller by low pressure present in the interior of the winding roller, whose casing is provided, in a manner known in itself, with gaps, has a relatively slip-resistant surface, and can carry, for example, a rubber coating. The process according to the invention can be operated with a web running speed in a typical range of approximately 30–400 m/min. In this case, it is advantageous if the speed of the air stream at the vacuum slot currently actuated is at least twice, and preferably at least three times, greater than the running speed of the material web. Preferably the vacuum flow is guided so that it flows around approximately ¾ of the circumference of the winding tube (that is, at least 270°).

Furthermore it is expedient if the material web on actuation of the separating device lies over at least approximately one half of the circumference of the winding roller, that is, at least approximately 180° of the winding roller. In some cases, the separating device lying inside the winding roller can lie in a chamber which is closed off from the interior of the winding roller and practically can be connected with the ambient air only via a corresponding slot, and, if needed, suitable gaps in the wall of the winding roller. On initiation of the web-separating process the chamber can be supplied with compressed air in order to break the adhesion of the web to the winding roller or to accelerate the ends of the web formed during the separation process in the radial direction outwards.

Providing the winding apparatus with fresh winding tubes from a magazine is the state of the art, likewise the arrangement of the tubes on a winding core and the transfer of the tubes and cores from the magazine into the positions for initial winding and final winding. Expediently the winding tube currently lying on the winding tube or the core carrying it is driven in a manner known in itself and with means known in themselves centrally in one direction which is opposite to the operational direction of the winding roller.

The bell-shaped cover is connected to a source of low pressure, also called a "vacuum source," and to means for opening and closing. Suitable vacuum sources, for example, vacuum pumps likewise belong to the state of the art here, like the required moving means, and do not need more detailed description here. The low pressure present typically lies in the range of approximately 250 to approximately minus 900 mbar.

The vacuum flow generated under the action of this low pressure in the interior of the bell-shaped cover can furthermore be supported in the manner known from WO 9906313 by lateral flows of ambient air. The form of the shells forming the bell-shaped cover is generally formed according to the invention so that between the inner walls of the shells and the fresh winding tube an annular gap for the passage of the vacuum flow arises. Generally the vacuum flow in this gap at the low pressure currently present has a flow rate which in the typical case is at least approximately twice as great as the running speed of the foil web. With the disposition of the vacuum slots at the end of this annular vacuum channel, the front end arising in web separation can be guided by the vacuum flow around nearly the entire circumference of the winding tube, preferably by at least approximately 270° of this circumference.

It is possible in principle to work with more than only one bell-shaped cover, although the use of a single bell-shaped cover is preferred as a rule for reason-s of simple construction. Along with this, the bell-shaped cover, or each bell-shaped cover, is in this case normally movable between a resting position and an operating position, which can be realized with means known in themselves. Furthermore, the moving processes for carrying out the process according to the invention, or required for the operation of the apparatus, can be carried out in a known manner with the customary pneumatic, hydraulic, or electrically actuated moving means. This lies in the scope of those skilled in the art and does not need particular explanation here.

BRIEF DESCRIPTION OF THE DRAWINGS

Embodiment examples of the invention will be explained in more detail below with the aid of the drawings. In these are shown FIG. 1 a frontal view of a schematically represented apparatus for the continuous winding of a running material web into a winding roll, onto which the web can optionally be wound with one or the other side lying outside, in a state in which a winding tube is nearly completely wound, FIG. 2 the apparatus according to FIG. 1, in which a winding tube with the start of the web initially wound on it is traversed from its position in which it is initially wound onto into its position for final winding of the winding roll, FIG. 3 a cross-section through the vacuum and knife cylinder feeding the web with a winding tube in its position in which it is initially wound onto in a state in which the web running over the cylinder is provided with a transverse separating cut, FIG. 4 a representation corresponding to FIG. 3, in which a cover shell which can be pivoted out has lifted up the start of the following web for introduction into the guide channel encircling the winding core, FIG. 5 a representation corresponding to FIGS. 3 and 4 in which the start of the web has been introduced into the guide channel encircling the winding tube, FIG. 6 a longitudinal section through the vacuum and knife cylinder, from which the bar carrying the knives can be seen, FIG. 7 an enlarged extract from FIG. 6, FIG. 8 an axial section through the vacuum and knife cylinder with winding tube in the raised state of the fingers of a knife shell according to FIG. 4, FIG. 9 an enlarged extract from FIG. 8, FIG. 10 a longitudinal section corresponding to FIGS. 6 and 7 through the vacuum and knife cylinder, which is provided with guides for the knife-carrying bar in the form of a circular arc, FIG. 11 a longitudinal section corresponding to FIG. 10, in which the knife-carrying bar can be pivoted by means of parallel linking arms on its end sides, FIG. 12 a schematic representation of a second winding process according to the invention with winding apparatus according to the invention in a first winding direction, in which the bell-shaped cover for initial winding is in the rest position and open, FIG. 13 a similar representation to that in FIG. 12, but in a second winding direction during operation, in which the bell-shaped cover for initial winding is in operating position and the shells are closed around a fresh winding tube, FIG. 14 the bell-shaped cover for initial winding in schematic representation with opened shells, and FIG. 15 the bell-shaped cover for initial winding of FIG. 14 with a fresh winding tube enclosed by the shells and lying on the winding roller, and FIG. 16 the half-schematic representation of an example of a web-separating device according to the invention.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
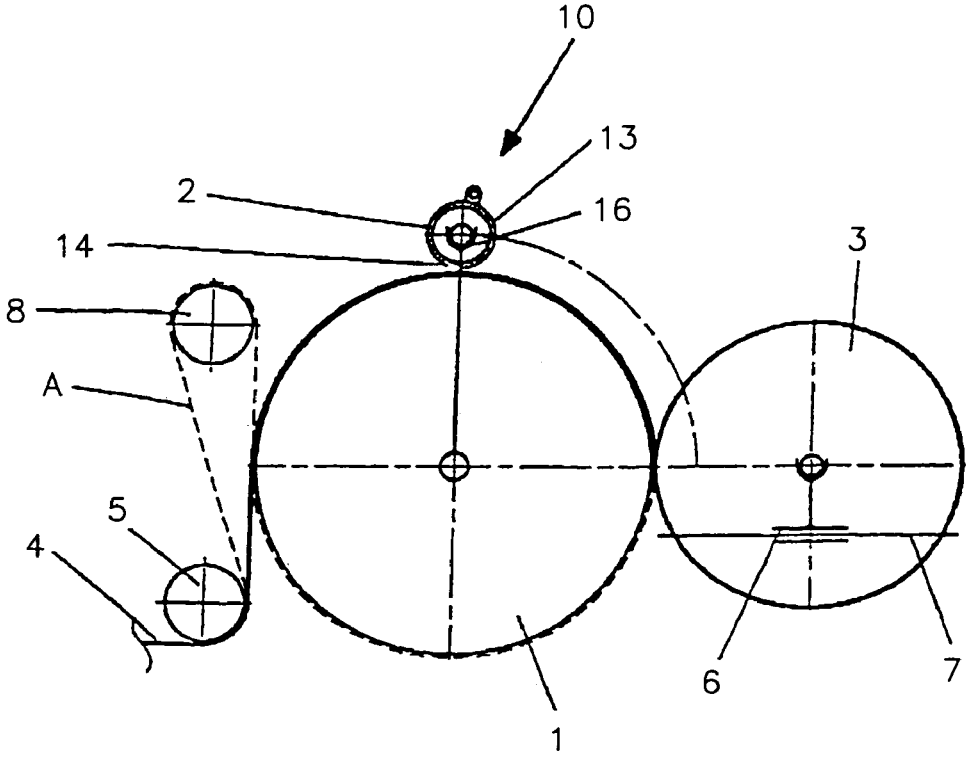

Front views of the vacuum and knife cylinder 1, the winding tube 2 in its initial winding position, and the almost completely wound winding roll 3 can be seen in FIG. 1. The continuously fed material web 4 is fed to the vacuum and knife cylinder 1 over the deflection roller 5. It then runs over approximately one half of the circumference of the vacuum and knife cylinder 1 and is then wound into the winding roll 3, where the winding core or the winding tube and the winding roll forming on it can, in order to be driven, be positioned directly on the circumference of the vacuum and knife cylinder. If the winding roll being formed is driven directly by the vacuum and knife cylinder 1, then it is a so-called contact winder. The winding roll can, however, be formed by a so-called gap winder, in which the winding roll or its winding core or winding tube is provided with its own drive mechanism.

The bearing, not shown, of the winding roll 3 is guided via guides 6 on fixed rods or rails 7 in such a manner that the winding roll stays at a distance from the vacuum and knife cylinder 1 corresponding to the increase in the diameter of said winding roll 3.

If the web is supposed to be wound into a winding roll 3, in which the other web side lies outside, the web 4 runs from the deflection roller 5 in the direction of the arrow A over the additional deflection roller 8 onto the vacuum and knife cylinder 1, with its direction of rotation reversed, where the corresponding web path is drawn with a broken line.

Figure 2:
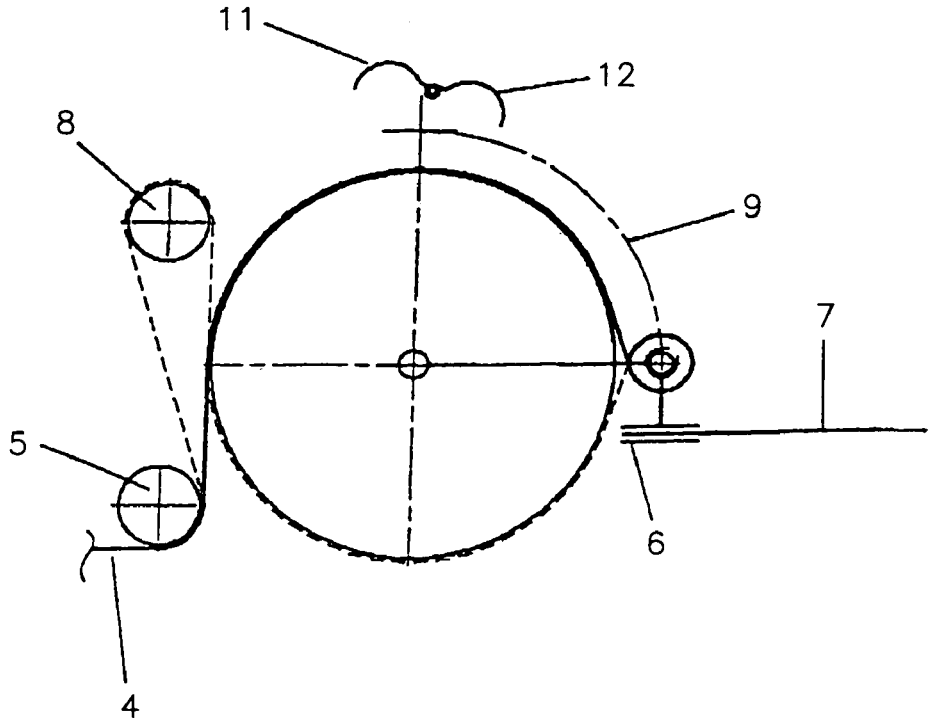

FIG. 2 shows the situation in which the continuously fed web is provided with a separating cut running transversely and the start of the web formed thereby is initially wound onto the winding tube 2, which then has been traversed from its winding position visible in FIG. 1, along the curved path 9, to its position visible in FIG. 2, where it is in a winding station for the completion of winding.

In FIG. 1 the winding tube 2 is enclosed by a housing 10 consisting of two hinged housing shells 11, 12, said housing concentrically encircling the winding tube 2 to form a guide channel 13. Between the apical edges of the shells 11, 12, which are closed to form a housing 10, an intake gap 14 is formed into which the start of the web, formed by a transverse separating cut, runs, according to the direction of rotation, from the left or from the right. As this happens, the respective edge of the intake gap 14 is pivoted into a diametrical plane of the vacuum and knife cylinder in which the edge is brought nearest to the circumferential surface of the vacuum and knife cylinder, said edge lifting the start of the web from the vacuum and knife cylinder.

The winding core or the winding tube 2 is mounted with its journals in a bearing shell 16 and provided with a drive mechanism in a manner known but not shown. From FIG. 3 the vacuum and knife cylinder 1 and the winding tube 2 with the housing 10 enclosing it can be seen in the position, which can be seen from FIG. 1, in which the web 4 has already been separated by a transverse separating cut and the winding tube 2 is in its initial winding position.

Figure 6:
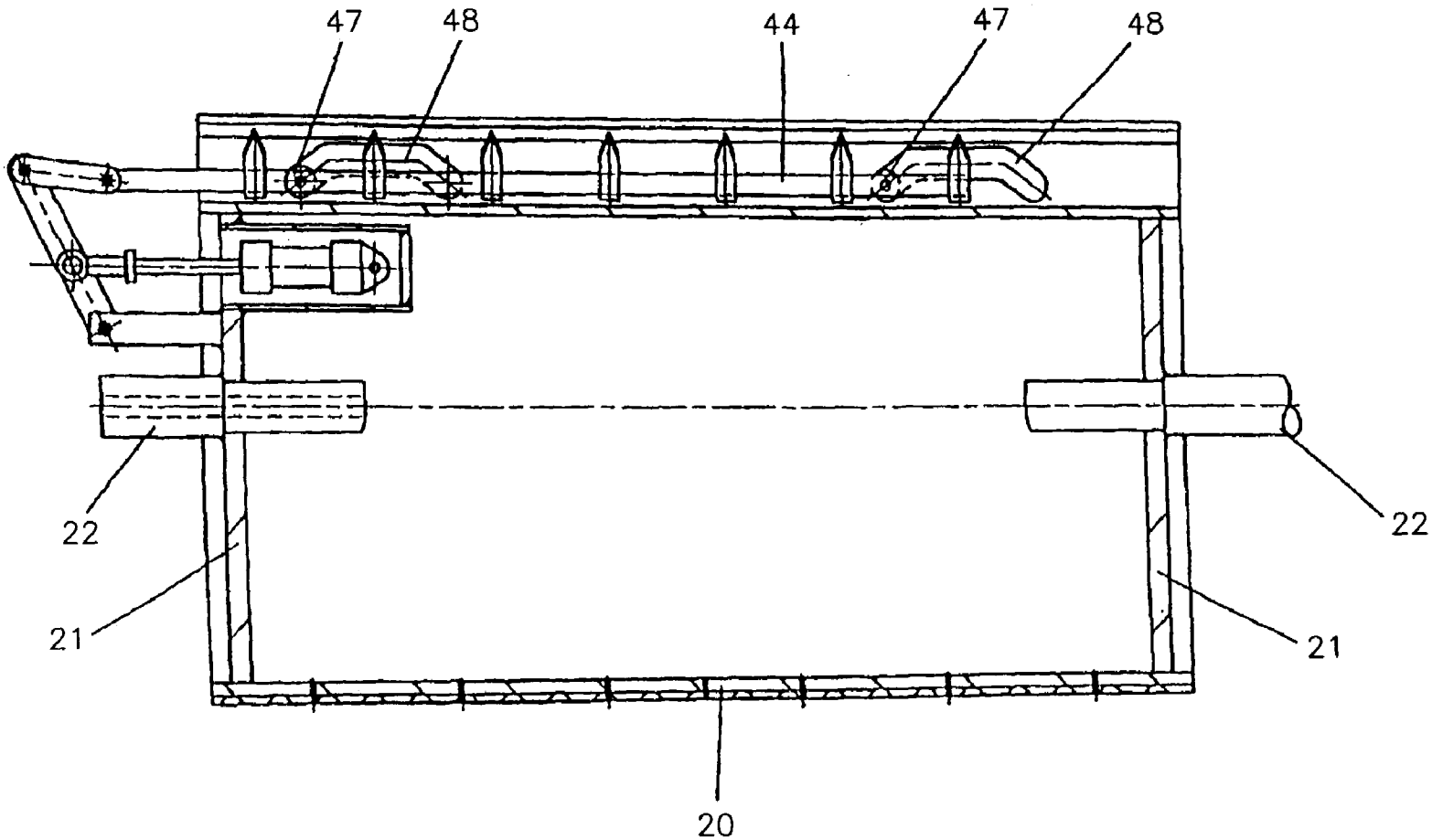

The vacuum and knife cylinder 1 has a steel casing 20 which is closed by apical plates 21, said casing carrying the journals 22 bearing and driving the vacuum and knife cylinder (see FIG. 6). The steel casing 20 is provided with vacuum holes 23 in rows running axially. The interior of the vacuum and knife cylinder 1 is connected to a vacuum source, in a known manner, by a line and a rotary transmission leadthrough.

The casing 20 of the vacuum and knife cylinder 1 is provided with a coating 24 of rubber or another elastomeric material, preferably vulcanized on, which the vacuum holes 23 also penetrate.

Figure 9:
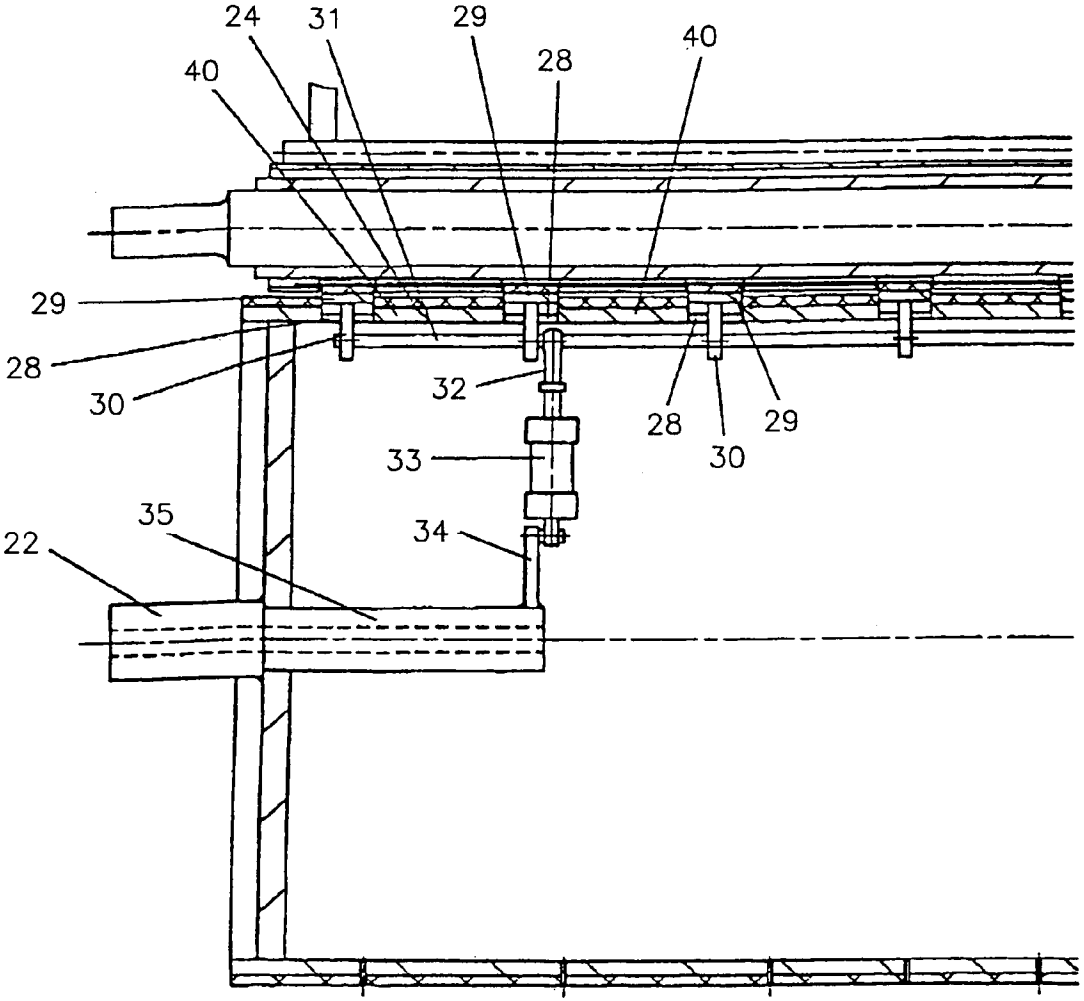

The steel casing 20, including the coating 24 enclosing it, is provided with a slot 25 running axially, which is penetrated by knives 26 for cutting through the web 4. The slot 25 is bordered by edges of the steel casing which are provided at equal intervals with recesses 28 running out freely in the circumferential direction. In these recesses 28 there are fingerlike plates 29 curved according to the radius of the vacuum and knife cylinder which seal the recesses 28 in the pivoted-in state (see FIG. 9). The plates 29 are also covered by the vulcanized-on rubber layer 24 which, however, is provided with separating cuts running in the circumferential direction in alignment with the lateral edges of the plates 29 50 that the plates 29 are pivotably connected to the steel casing 20 at their inner ends only by the rubber layer 24. The plates 29 which can be pivoted out are provided with welded-on rams 30 which are connected to one another by a bar 31 running axially. To the bar 31, the piston rod 32 of a pneumatic cylinder 33 is pivotably connected, said pneumatic cylinder being hingedly connected to a tie rod 34 which is welded to the inner section 35 of the journal 22. Compressed air is fed to the pneumatic cylinder 33 via rotary transmission leadthroughs not shown.

There are two pneumatic cylinders 33 for pivoting in and pivoting out of the finger-like plates 29 on both sides of the slot 25.

Figure 7:
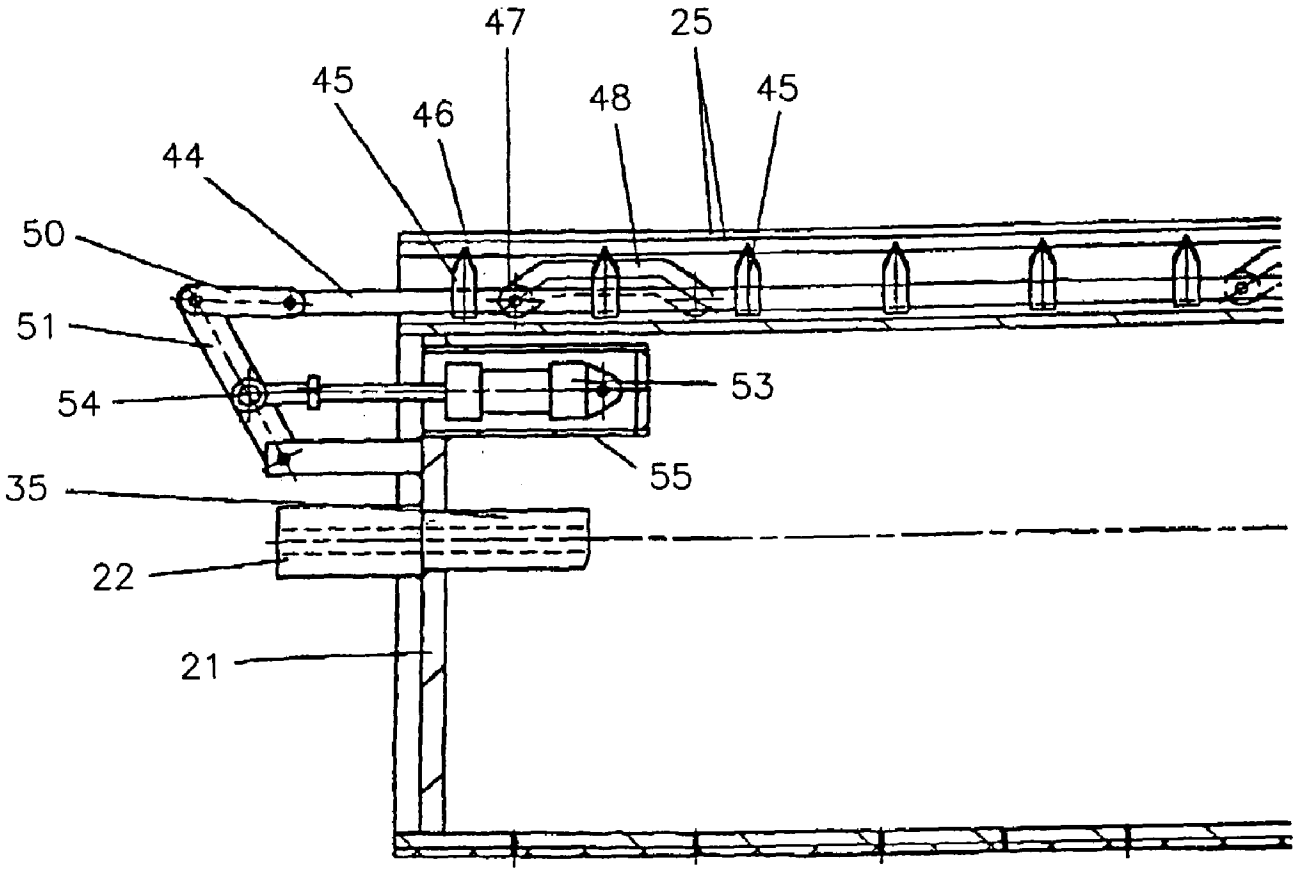
Figure 8:
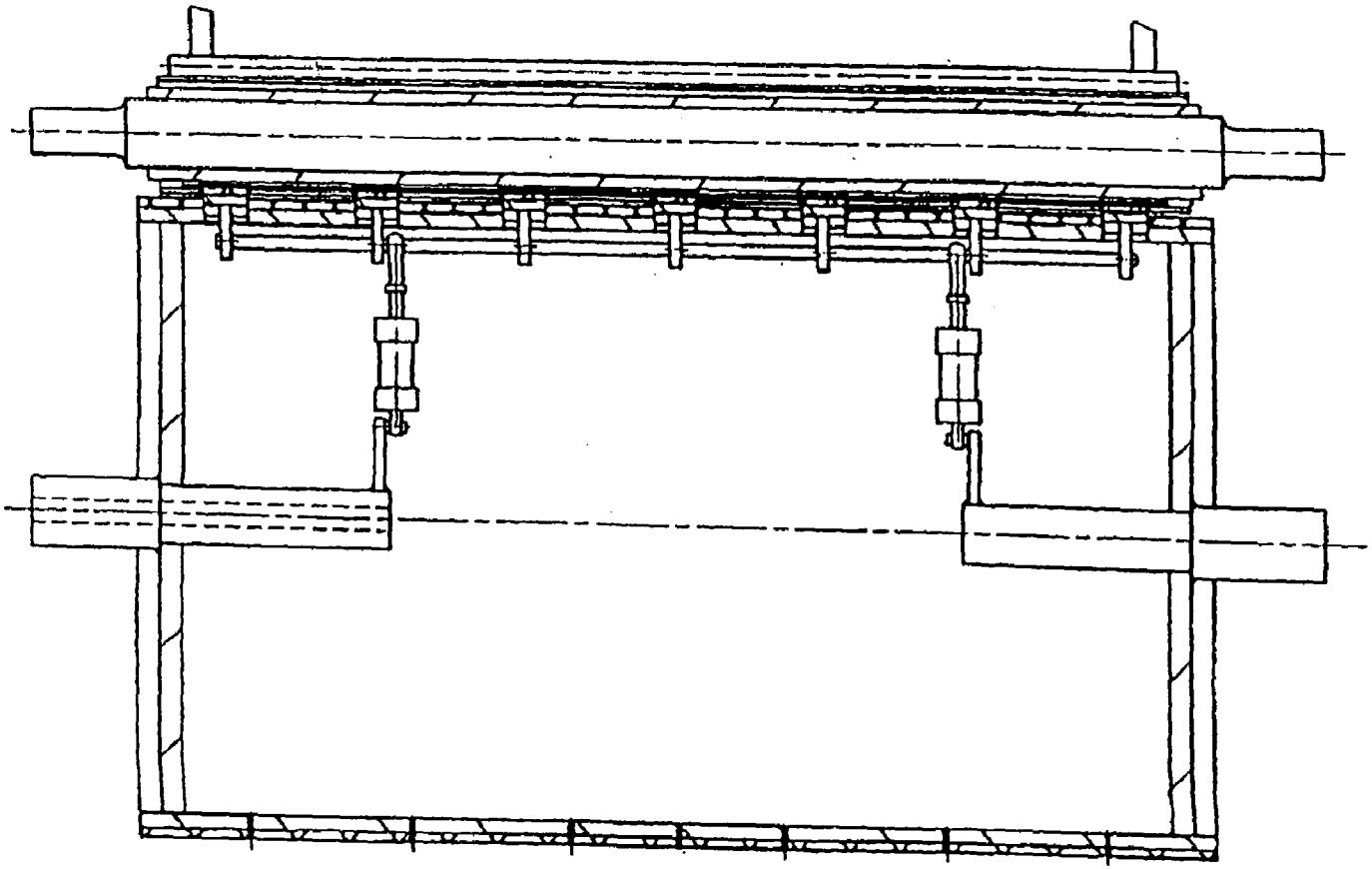

The legs 41, 42 of a U-shaped profile 43, in which a knife-carrying bar 44 is guided, are welded to the cross pieces 40, whose apical sides border the gap 25 and which are disposed in the manner of a grid enclosing the finger-like plates 29. The knife-carrying bar 44 is provided at equal intervals with knives 45 with triangular cutting edges 46 which serve to separate the web 4 transversely (see FIG. 7). The knife-carrying bar 44 is provided in the area of its front and back ends on both sides with rollers 47 which are guided in trapezoidal guide grooves 48 which are incorporated into the inner edges of the legs 41, 42 of the profile 43. The knife-carrying bar 44 is hingedly connected by a linking arm 50 in the manner of a connecting rod to a lever 51 pivotably mounted on the apical wall 21 of the vacuum and knife cylinder 1, said lever in turn being hingedly connected, for its back-and-forth pivoting, to the piston rod 54 of a pneumatic cylinder 53 which is pivotably mounted in a sleeve 55 which is welded into the apical wall 21.

By appropriate axial displacement of the knife-carrying bar 44 via the drive mechanism 50 to 55 the knives 45 are raised out of the gap 25, traversed in the axial direction, and run into the gap 25 once again due to the fact that the rollers 47 run up the inclined surfaces of the trapezoidal guides 48, are traversed in the axial direction over the straight middle section, and then are drawn in once again by running off on the other oblique edge. In order to execute a penetrating cut, the middle sections of the guides 48 running parallel to the axis of the vacuum and knife cylinder are implemented to be at least as long as the distance of the knives 45 from one another.

The shells 11, 12 of the housing 10 enclosing the winding tube 2 are mounted pivotably about a common axis 60 (see FIG. 4) and are connected to supporting plates 61 which are pivotably mounted concentrically to the central axis 62 of the winding tube 2. For pivoting the supporting plates 61, said plates are guided via guide rollers 63 in a fixed guide 64 which is curved concentrically to the axis 62. For pivoting the shells 11, 12 from their positions shown in solid lines into the positions 11', 12' shown in broken lines, the shells 11, 12 are jointedly connected on their outer sides with linking arms 66, 67 whose other ends are jointedly connected to one another and are connected to the piston rod of a pneumatic cylinder 69 pivotably about the common pivot axis 68, said pneumatic cylinder being jointedly connected to the supporting plates 61. Through appropriate actuation of the pneumatic cylinder 69 the housing shells 11, 12 can be pivoted out to release the winding tube 2 and pivoted in to form the annular guide channel.

The housing shells 11, 12 are each provided with vacuum nozzles 70, 71 in rows through which, according to the direction of rotation of the vacuum and knife cylinder and the winding tube, air is suctioned in to support the laying of the start of the web in the guide channel around the winding tube 2.

Instead of the vacuum nozzles 70, 71 the blast air nozzles 72, 73 shown as broken-lines and disposed in rows can also be provided through which blast air can be blown into the annular guide channel in order to feed, in an appropriate manner, the start of the web around the winding tube 2.

Figure 3:
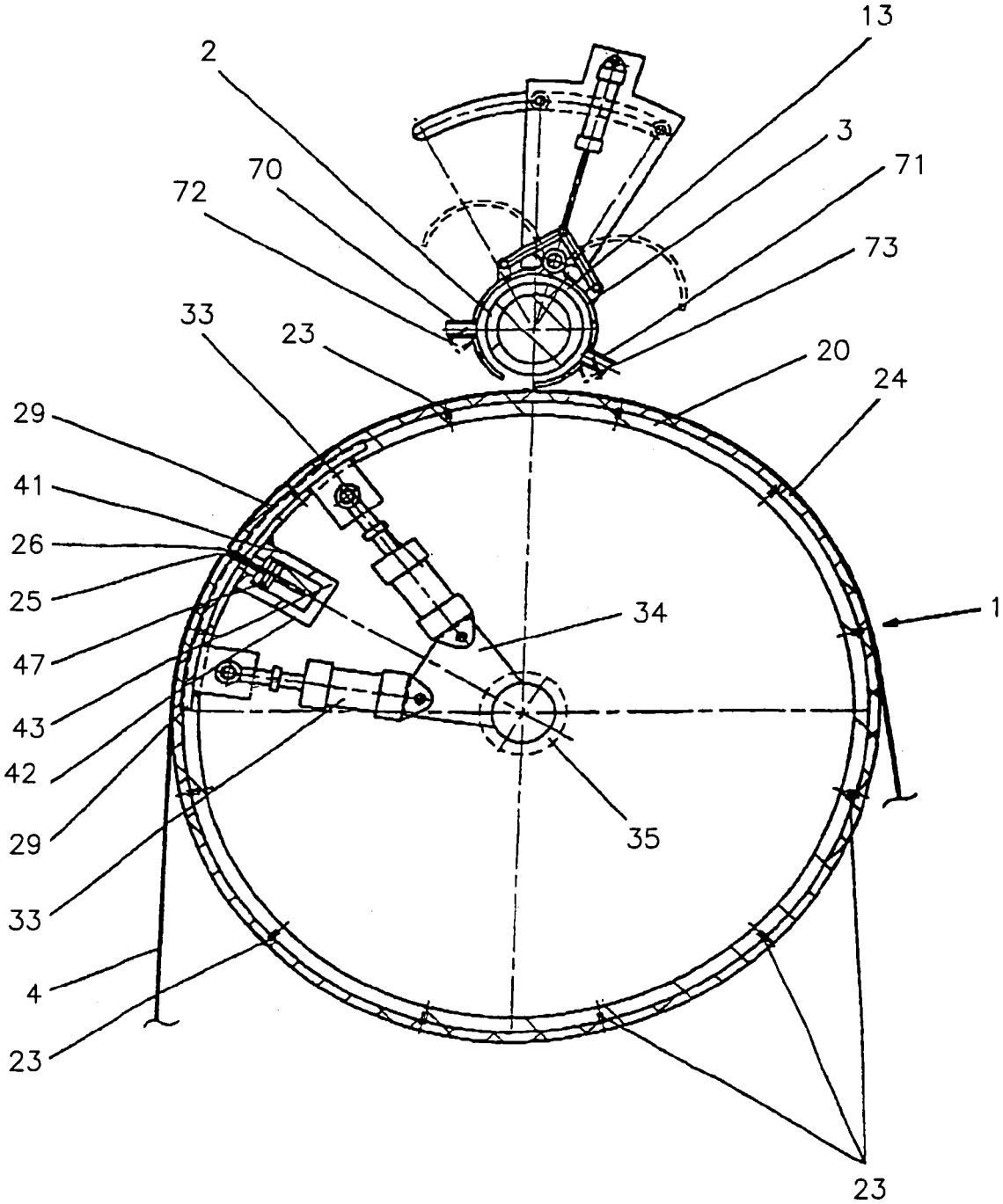

From FIG. 3 the state can be seen in which the separating knives 26 have completely cut through the web 4 by traversing in the axial direction in the slot 25, where the end of the web to be wound and the start of the web formed by the separating cut is held fast on the vacuum and knife cylinder by the vacuum holes 23.

Figure 4:
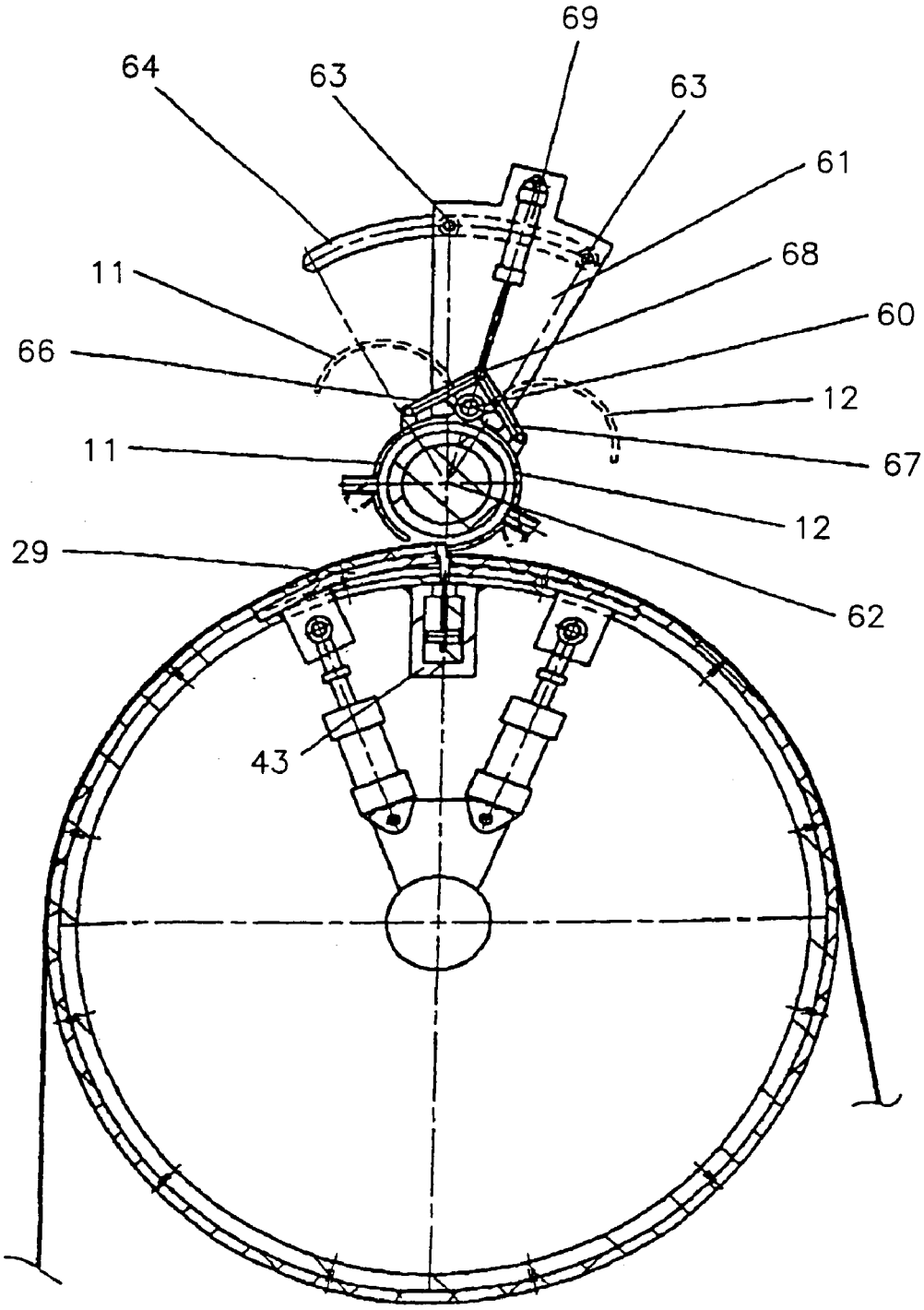

As can be seen from FIG. 4, the fingerlike plates 29, through appropriate pivoting put by the pneumatic cylinder, lift the start of the web from the jacket cylinder of the vacuum and knife cylinder so that it is taken up by the fingers of one edge of the intake slot 14 of the housing 10 and is introduced into the annular guide channel 13.

Figure 5:
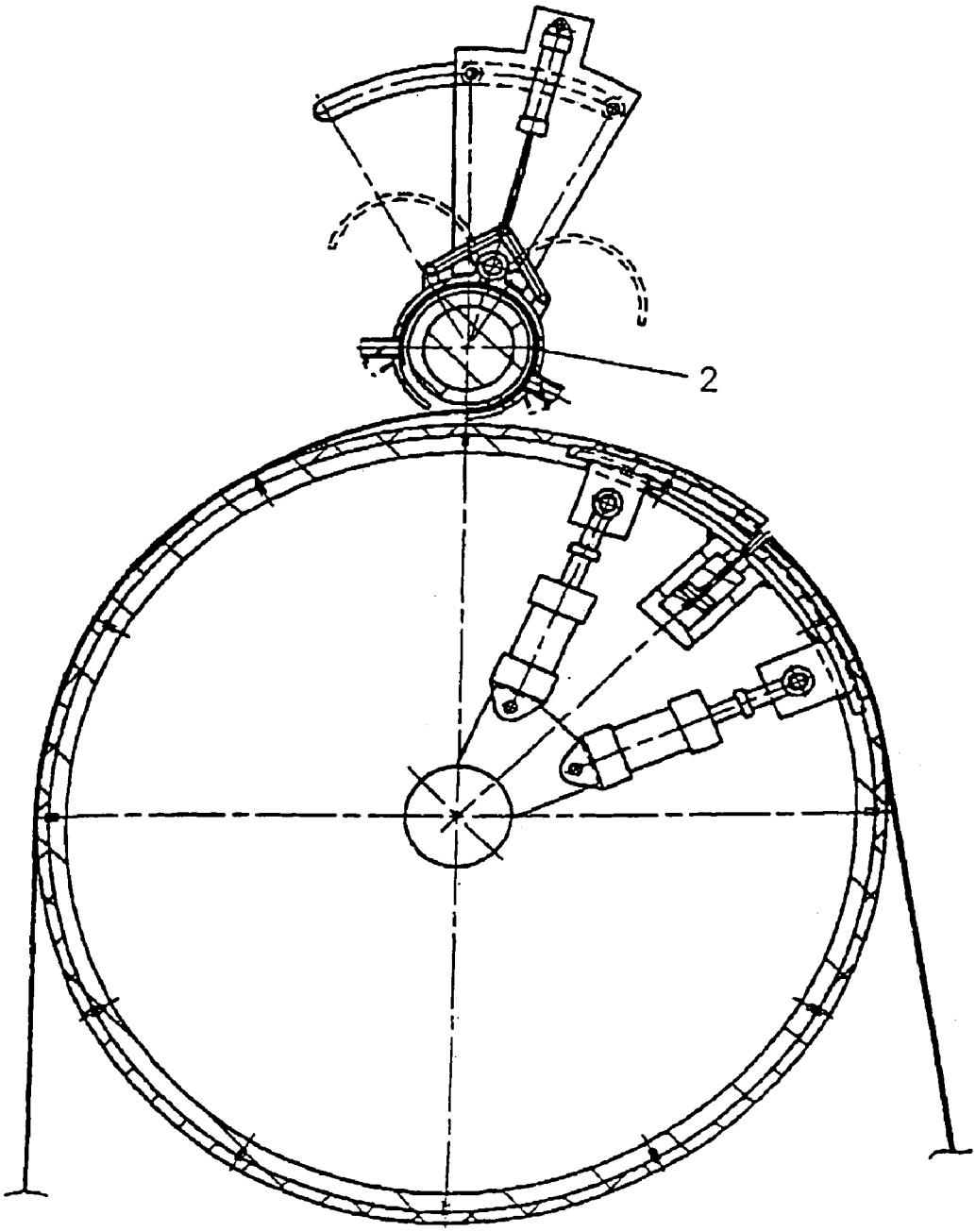

In FIG. 5 the situation can be seen in which the end of the web of the completely wound winding roll has fed and the start of the web has substantially encircled the winding tube 2 to be initially wound onto.

Figure 10:
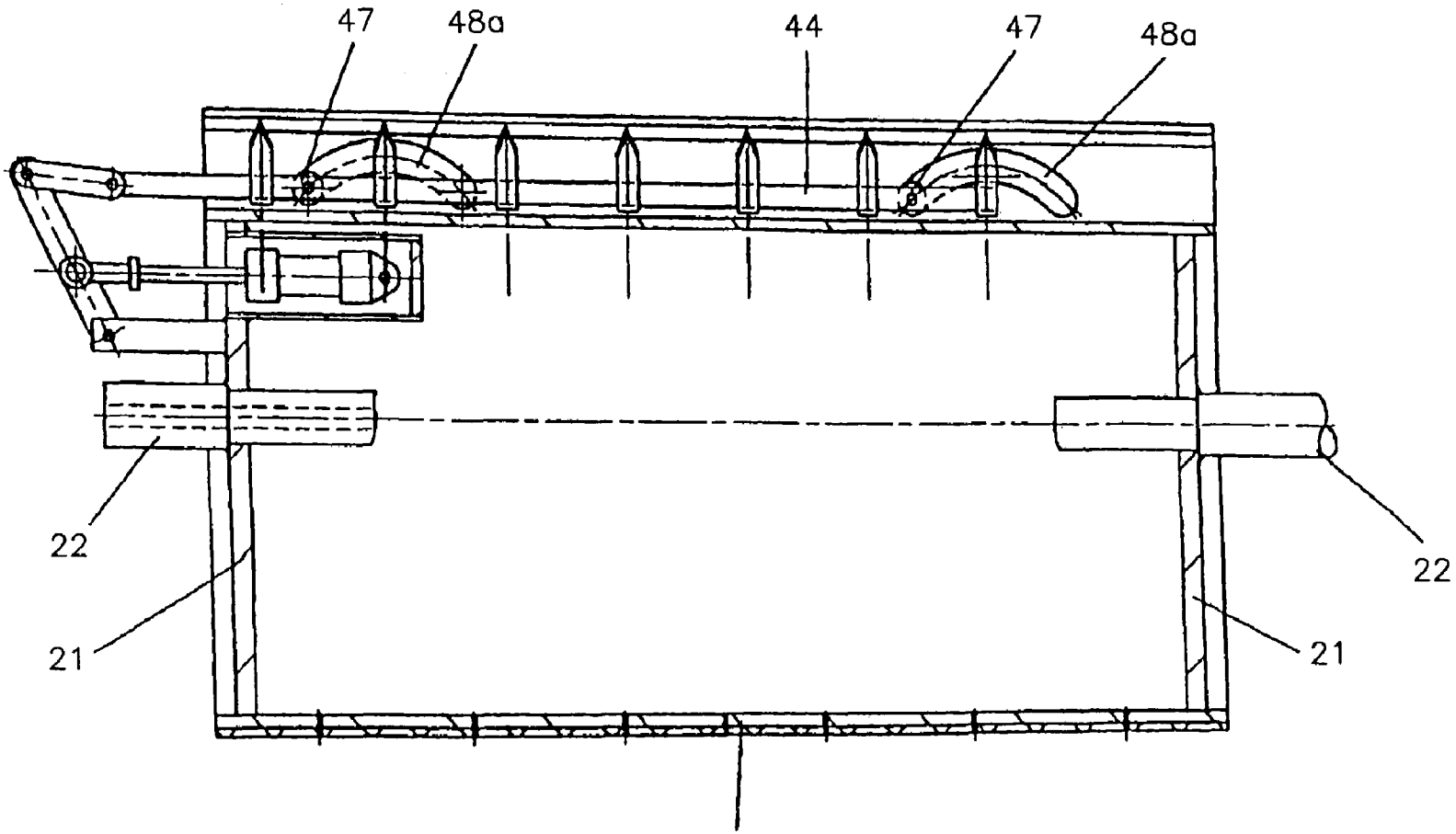

In the embodiment example according to FIG. 10 the knife-carrying bar 44 is guided by the rollers 47 in guides 48*a* in the form of a circular arc, said guides being incorporated in the inner edges of the legs 41, 42 of the profile 43. Through this type of guiding, the knife-carrying bar 44, and thus also the knives 45, execute a movement in the form of a circular arc, which has as a consequence the fact that, on the cutting movement in the plane of the web to be separated, a cutting movement transverse to it is superimposed. In order to provide the web with a penetrating separating cut, the cutting knives execute a movement in the plane of the web in the direction of the cutting cylinder's axis which is at least as large as the distance of the individual knives 45 from one another.

Figure 11:
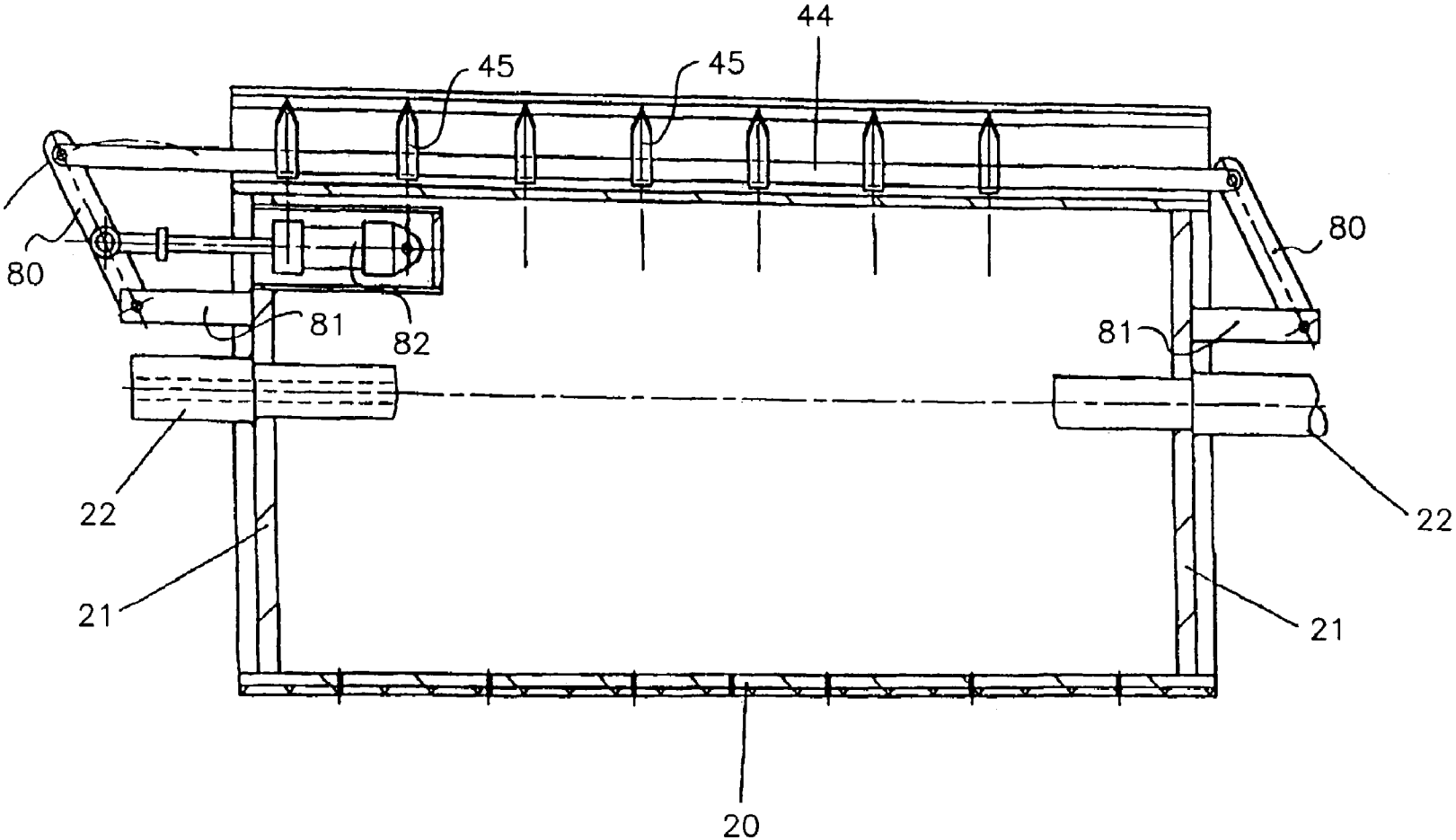

In the embodiment example according to FIG. 11 the knife-carrying bar 44 is mounted on its ends on parallel linking arms 80 whose other ends are mounted on supporting brackets 81 which are welded to the apical plates 21 of the knife cylinder. The length of the linking arms is chosen so they impart a curvilinear movement to the knife-carrying bar, by which the knives 45 are guided through the web to be cut in a manner such that a transverse movement is superimposed on the cutting movement in the plane of the web. In so doing, the curvilinear movement of the knife-carrying bar is aligned in such a manner that the knives reach the apex of the movement in the form of a circular arc at the midpoint of their back-and-forth movement. For pivoting the parallel linking arms 80, the piston rod of a pneumatic cylinder 82 is hingedly connected to one parallel linking arm, said pneumatic cylinder in turn being pivotably mounted in a holding device of the knife cylinder.

Figure 12:
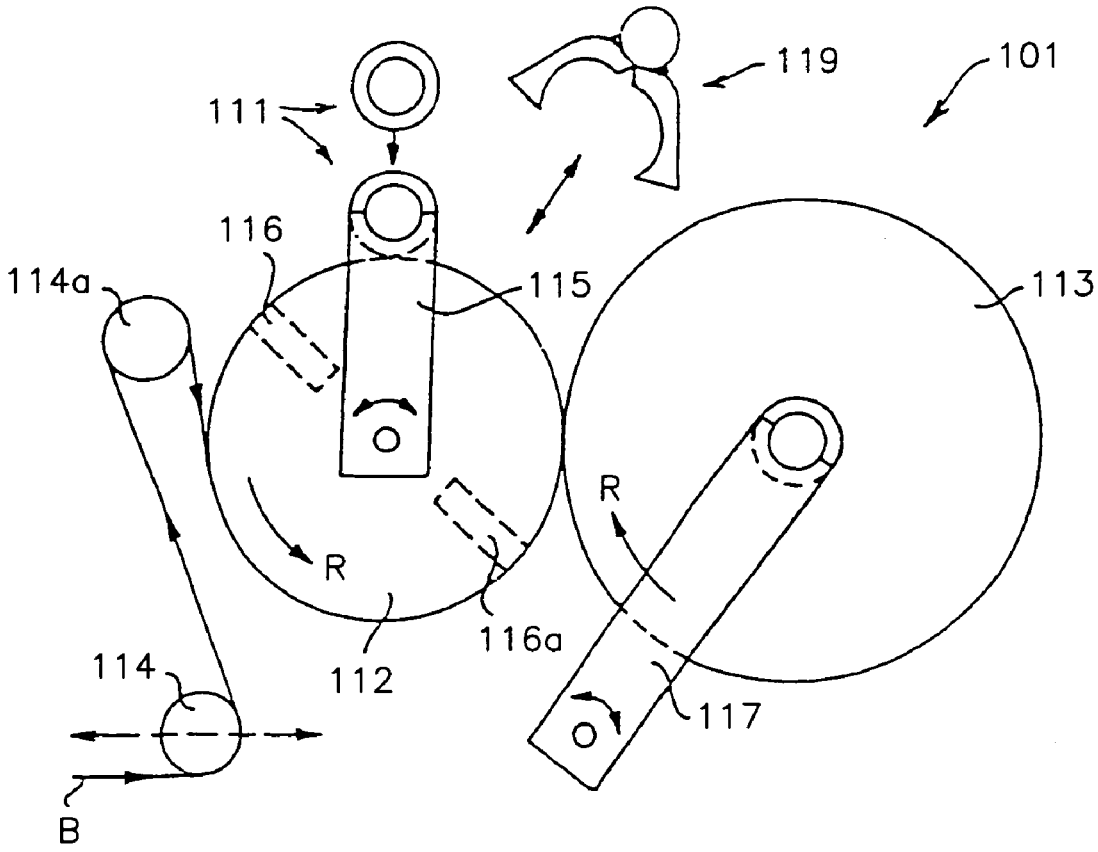
Figure 13:
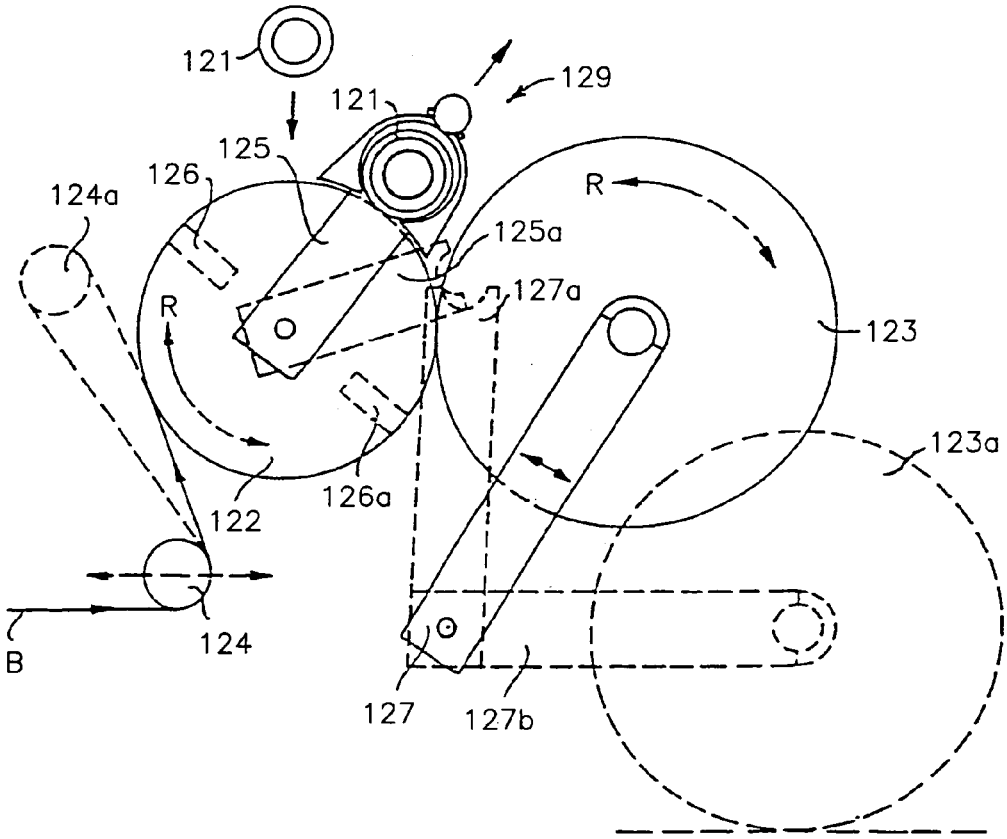

Concerning FIGS. 12 and 13, it must first be emphasized that the scheme of initial winding and final winding represented therein is not critical for the invention in so far as it deals with the feeding to the winding tube and its transfer from a first to a second winding state. On the contrary, the initial winding with the aid of low pressure with bidirectional operation and web separation is essential for the invention.

According to the scheme represented in FIG. 12 the web B, which, for example, is an endless plastic foil, runs in the direction to and around the deflection roller 114 which can be displaced in a known manner to regulate the web path in the direction of the double arrow drawn as a broken line. Then the web runs to and around a second deflection roller 114*a* and from there onto the winding roller 112 which is rotatingly driven by a drive mechanism, not shown, in the direction of the arrow R, i.e., counterclockwise, at the desired operating speed. Two separating devices 116, 116*a* are disposed in the interior of the winding roller 112. The use of two separating devices lying peripherally opposite one another is not critical, however. Moreover, processing can also be with a single separating device or with several winding rollers uniformly distributed around the circumference of the winding roller, which, not least of all, also depends on the circumference of the winding roller and its operating speed.

For the initiation of initial winding the first pivot arm 115 takes up a fresh winding tube 111 which has a winding core in a known manner and is laid into the end of the pivot arm 115 from a magazine (not shown) with a conveyance device (not shown). In so doing, the winding tube comes in contact with the winding roller 112, or very near to it, and is set in rotation running counter to the winding roller, i.e., clockwise, by it and/or its own central drive mechanism (not shown). This is denoted as the "first winding state or phase." In the representation of FIG. 12, the bell-shaped cover 119 is still in the resting state, that is, it is at a distance from the winding roller 112 and its shells are open.

Since in the tube change's state represented in FIG. 12 still none of the separating devices 116, 116*a* have been actuated, the web B runs from the winding roller 112 onto the nearly full foil winding 113 in the "second winding state or phase." The foil winding 113 is also connected to a central drive mechanism (not shown) and rotates in the direction of the arrow R, i.e., clockwise.

It must be emphasized that the second winding state in FIGS. 12 and 13 is in fact represented by a pivot arm 117, 127 in order to make the final winding occurring there, as well as the release of the full foil winding understandable in a simple manner, but that the arm 117, 127 can naturally be replaced by a carriage known in itself which brings, by means of a moving device, the holding device for the foil winding 113, 123 into its respectively required position, which is necessary for the take-up of the winding tube 111, 121 on which initial winding is to take place, for the preferably adjustable contact force on final winding of the foil winding on the winding roller, and finally for the carrying off of the completed foil winding.

Likewise, it is possible in the implementation of the present invention to guide the winding roller on a carriage and to hold the foil winding stationary in the second winding state, as is described in the patent specification U.S. Pat. No. 5,275,348.

The advantages of the adjustability of the pressure (linear pressure, for example, in kg/m) with which the foil winding 112, 123 is laid on the winding roller 112, 122 in the second winding state, to a value between zero and several hundred kg are described in detail in the aforementioned patent specification U.S. Pat. No. 4,191,341 to which reference is made hereby and whose control of the pressure between the winding roller and foil winding in the second winding state is preferably used in the present invention.

The control of the course of winding also preferred for the present invention and the measures, with regard to apparatus, which are suitable for this purpose are described in the aforementioned patent specification U.S. Pat. No. 5,275,348, to which reference is also taken for further explanation.

FIG. 13 shows in turn a web B which runs to and around the first deflection roller 124 but not to and around the deflection roller 124*a*, not in operation here and represented by a broken line, but rather directly to the winding roller 122 rotating in the direction of the solid part of the arrow R, i.e., here clockwise, in whose interior two separating devices 126, 126*a* lying opposite one another peripherally are also disposed. The direction of winding is, in other words, also reversible when the web B always runs in the same direction into the foil winder, i.e., in FIGS. 12 and 13 uniformly "from the left downwards." The pivot arm 125 is henceforth in a position between 1 o'clock and 2 o'clock and the winding tube guided by it is encircled by the bell-shaped cover 129 in the operating position.

As explained in more detail below, the section of the web still running onto the foil winding 123 is separated by actuation of one of the separating devices 126 or 126*a* and the front end of the following section of the web in the bell-shaped cover 129 arising in so doing is initially wound onto the fresh winding tube 111 in the interior of the bell-shaped cover 129.

Then the completed foil winding 123 can, by actuation of the pivot arm 127, be brought into the position 127*b* drawn as a broken line, i.e., into the unloading position 123*a*, and transported away. The pivot arm 127 is then moved from the position 127*b* drawn as a broken line into the position 127*a*, also drawn as a broken line, and is then ready to take up the winding tube initially wound in the bell-shaped cover 129.

For the initiation of the transfer of the initially wound winding tube from the first into the second winding phase the bell-shaped cover 129 must be opened and the pivot arm 125 must be brought into the position 125*a* drawn as a broken line. After the release of the initially wound foil tube the pivot arm 125 returns once again into the perpendicular position according to FIG. 12 before it takes up the next fresh winding tube.

Figure 14:
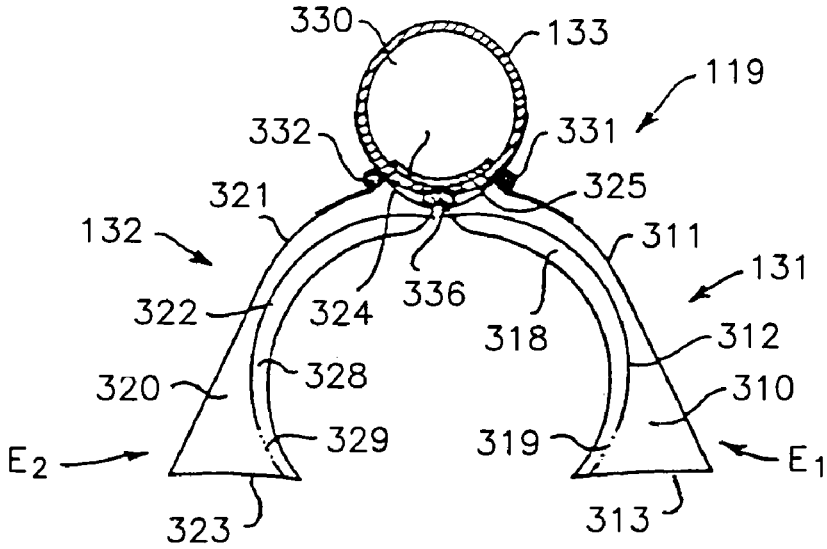

FIG. 14 shows the scheme of the bell-shaped cover 119 for initial winding, already indicated in FIG. 12, in the opened state. Its two shells 131, 132 are, for example, hingedly connected with hinges 331, 332 on the carrier 133. Each shell has an essentially closed interior 310, 320 which is encircled by an outer wall 311, 321, an inner wall 312, 322, a connecting wall 313, 323 adapted to the form of the winding roller, i.e., correspondingly arched, and two side walls. The side walls (of which only the walls 318, 328, lying behind as seen by the observer, are represented) each have a wall continuation with an approximately semicircular recess which corresponds to the form of the winding tube and encircles it so that in the case of an interior 310, 320, each connected to the vacuum source, and the low pressure then prevailing therein, a lateral flow of air to minimize [sic].

The vacuum slots 319, 329 are disposed near to the free lower ends E1, E2 of the shells 131, 132, and each cavity 310, 320 has at its upper end a passage 324, 325 for connection to the interior 330 of the carrier tube 133. It is understood that the carrier for the bell-shaped cover does not necessarily also have to serve as a connection to the vacuum source. This connection can also be realized by a separate and, for example, flexible line which, in some cases, is connected to the (omitted to simplify the representation in the figures) means for moving the bell-shaped cover from the operating position into the resting position and for opening and closing of the shells. The devices for the movement of the bell-shaped cover from a "resting position" into an operating position are preferred but not critical for the invention. On the contrary, the capability of shells to open and close the bell-shaped cover is essential because this is necessary [for] the introduction of the fresh winding tube into the first winding state (or "initial winding state") and the transfer of the initially wound winding tube from the first into the second winding state (or "final winding state").

Continuous as well as discontinuous gaps are understood here by the term "vacuum slot," that is, the "vacuum slot" can also be a row of holes with the same effect.

For the control of the vacuum flow, a slide 334 is disposed in the present example in the carrier 133 in order to block the connection to the vacuum source either for both shells 131, 132 (if the bell-shaped cover is in resting position or on the way from or to its operating position) or (in operating position according to FIG. 14) to produce the connection of the vacuum source to only one of the two cavities 310, 320.

Figure 15:
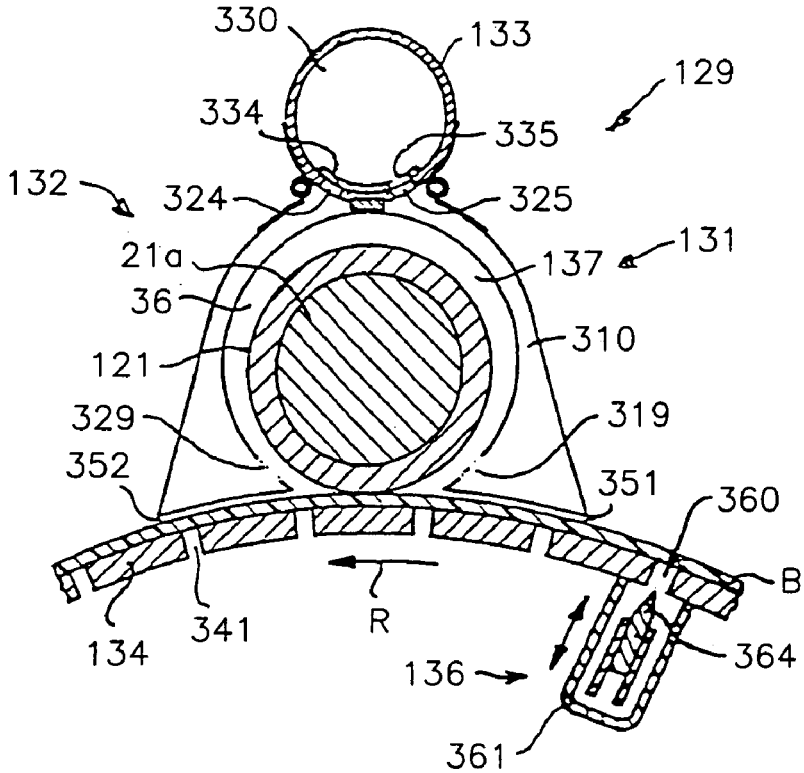

FIG. 15 shows the bell-shaped cover 129 of FIG. 14 now in operating position on the winding roller. It is understood that the bell-shaped cover only closes when the fresh winding tube 121 with its core 121*a* has been transferred by a pivot arm according to FIG. 12, or a mechanism having the same effect, from the magazine into the initial winding position according to FIG. 15 and is held in this position.

Only a part of the circumferential surface of the winding roller 134 is shown in FIG. 15 to simplify the representation, said winding roller being provided with a plurality of gaps 341 preferably distributed approximately uniformly on the circumferential surface of the winding roller in order to hold the foil web B, in a known manner, firmly on the winding roller under the action of the low pressure prevailing in the interior of the winding roller.

On actuation of the cutting device 136 the foil web B is separated, in a manner described in more detail below, by a coordinated cut running transversely to the direction of movement (counterclockwise, arrow R). For this a plurality of separating elements 364 is disposed so as to be jointly movable in the direction of the double arrow in and through the slot 360. To generate the coordinated cut running transversely over the web the separating elements for effecting the web separation are moved radially (that is, in the direction of the double arrow) outwards as well as axially (that is, in the direction perpendicular to the plane of the drawing). The length of the movement in the axial direction is chosen so that each separating element travels through at least the distance to the adjacent separating element.

The combination of the movement in the radial and axial direction is essential for a smooth web separation in the processing of the foil webs because they have, as a rule, a certain extensibility and a tendency to yield from by a blade acting on them without the support of the foil. With respect to pointed separating elements this inclination is less pronounced, that is, a perforation has fewer problems but is not sufficient for a quick and smooth web separation. The necessary additional separating effect is realized by the axial movement of the pointed separating elements preferably provided with sharp side edges, as explained in more detail below.

Through the separating cut, the back end of the preceding foil section is formed, said end being drawn past on the bell-shaped cover 129 for initial winding and running onto the (not represented here) final foil winding. At the same time the front end of the following web section arises through the cut, said web section to be initially wound onto the winding tube 121.

It lies within the scope of the invention to generate low pressure in a chamber 361 encircling the cutting device 136 in order to accelerate the front end of the following material web outwards in the radial direction in order at least to reduce the adhesion to the winding roller. However, this measure is not critical.

It is essential that the front end, formed in the web separation, of the following material web B is laid and initially wound on the winding tube in the area of the bell-shaped cover 129 by local low pressure between the winding tube 121 and the front end of the web B, and in fact according to the invention also during bidirectional operation of the winding apparatus.

In general the "downstream" shell, i.e., in FIG. 15 the shell 131 lying "behind" in the direction of movement R of the web B, and not the shell 132 lying "upstream" or more "to the front" in the direction of movement, is always actuated for this. This actuation is done by the interior of the corresponding chamber being connected to the vacuum sources, here, for example, coincides by actuation of the slide 334, so that the opening 335 in the slide coincides with the opening 325 on the upper end of the shell 131 and thereby the interior 310 of the shell 131 is connected to the vacuum source via the interior 330 of the carrier 133.

As a consequence of the low pressure thus generated in the interior 330 of the shell 131, ambient air is suctioned in through the gaps 351, 352 between the web B on the winding roller 134 and produces in the channels 136, 137 a vacuum flow going through the vacuum slot 319 of the shells 131. At an air flow rate which, as already indicated, is preferably at least twice as great as the running speed of the web, the separated front end of the following web section is drawn into the channel 136 and through the channel 137 and is established in them during continuing rotation of the winding tube 121. Generally the common length of the channels 136, 137 is chosen so that they include at least 270° of the circumference of the winding tube. By arranging the vacuum gap 319 of the shell 131 near to its lower end E1 (FIG. 14) the vacuum flow guided through the channels 136, 137 on actuation of the shell 131 surrounds the winding tube to a nearly equal extent.

Through the continued rotation of the winding tube 121 each subsequent layer of the foil web B, which is running on the winding tube 121, fixes the layers already present there so that a extension-resistant connection between the foil web B and the winding tube 121 occurs, that is, the critical part of the initial winding process is concluded and the tube 121 initially wound with several layers of the foil web can be transferred from the first into the second winding state as explained above.

With the direction of the winding roller 134 reversed (that is, clockwise and counter to the direction R the initial winding process runs in an analogous manner, that is, the front end of the web B is initially wound with the aid of the vacuum flow which in turn is suctioned through the gaps 351, 352, this time however by actuation of the shells 132 by the corresponding interior 320 being connected to the vacuum source via the slide 334 converted for the release of the 324 [sic] and the vacuum flow arising thereby first running into the channel 137 then into the channel 136, and finally through the vacuum gap 329 on the free lower end E2 of the shell 132. In so doing the separation process is effected by the separation device which runs next to the gap 352.

Figure 16:
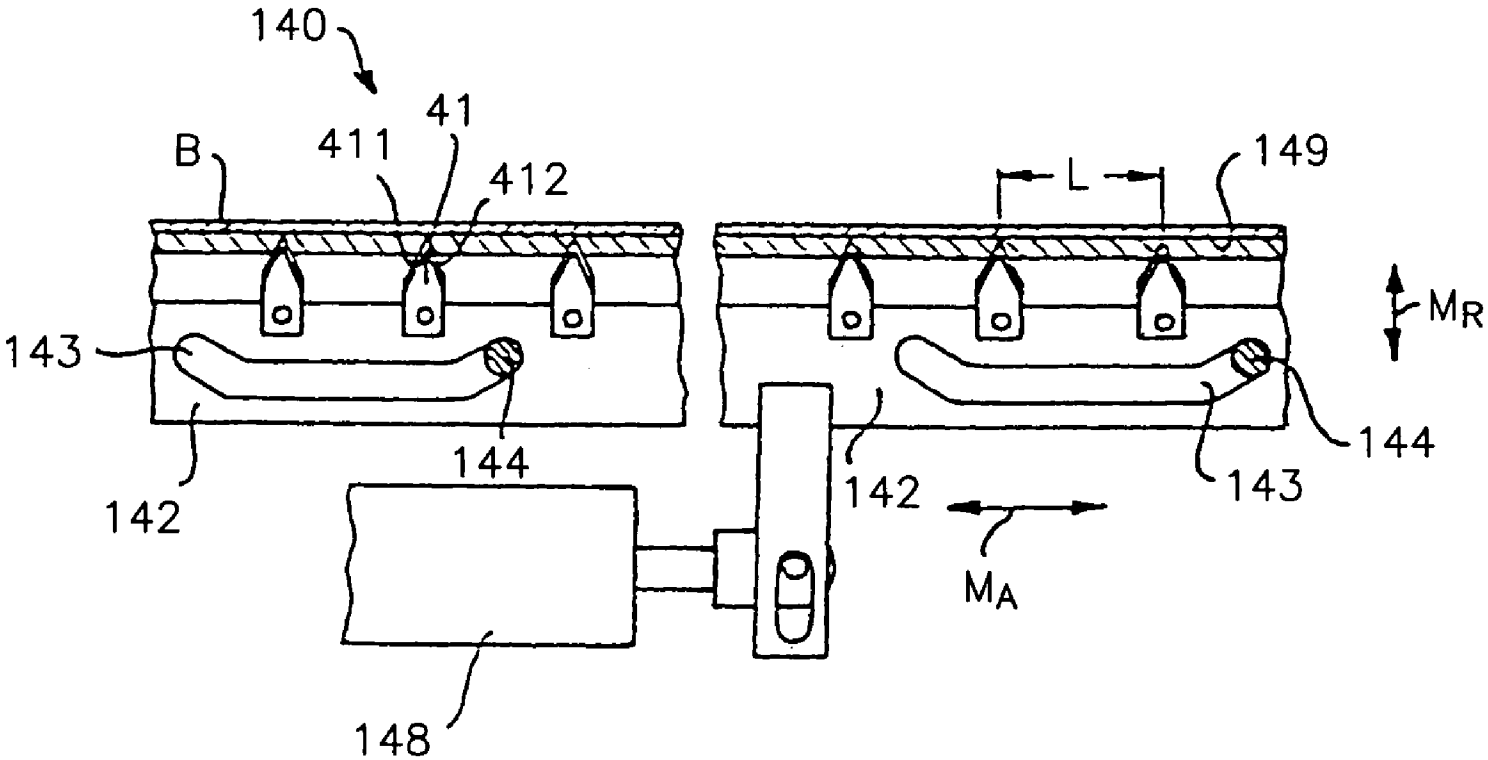

FIG. 16 explains the principle of a preferred web separation apparatus 140 according to the invention which can be used not only for the web-winding processes described here or the new web-winding apparatus described here but rather also for other purposes which required a quick, reliable, and smooth separation of a material web, in particular a polymer foil web.

The action of a web-separating apparatus 140 according to the invention is based essentially on the fact that several, for example, pointed separation elements 141, whose movement is connected, are guided via a slide 142 outwards in the radial direction (that is, the directions of the double arrow MR) through the (not represented in FIG. 16) slot in the circumferential surface of the winding drum and in so doing accordingly perforate the web B and furthermore in the axial direction (that is, in the direction of the double arrow MA) are moved at least far enough that each of the elements 141 travels at least a path of the length L corresponding to the distance between two adjacent elements 141. Thereby the initial perforation of the web B is converted into a penetrating cut with the aid of the sharp side edges 411, 412. The separating technology is, as already indicated, advantageous for the web separation of polymer foils, which are extensible as a rule.

This can be achieved in a manner which is simple in construction and on account of that preferred due to the fact that the separating elements 141 are disposed on the slide 142 formed as a guiding connecting link, said slide being guided (in a manner not shown) so that it is, on each actuation of the drive mechanism 148 from the recesses 143 and the fixed guide pins 144 in the direction of the double arrow MA, first in the radial direction outwards brought to contact of all the pointed separation elements 141 with the foil web, then moved laterally in the axial direction, and finally once again in the radial direction inwards. In so doing the pointed separation elements 141 cause first a perforation and immediately following thanks to the axial movement by means of the cutting edges 411, 412 a cutting through of the foil web. Through the additional movement of the connecting link slide 142 up to the stop of the pin 144 at the opposite end of the recess 143, the knives 141 are finally withdrawn once again so far that the foil web B does not come into contact with the separating elements 141.

As can be seen from FIG. 16 the boundary of the movement defined by the openings 143 in the axial can definitely be greater than the distance between two adjacent separating elements 141, in particular if the reliability and completeness of the web separation is insured thereby. Furthermore, the movement of the separating elements in the axial direction does not necessarily have to be linear but rather can, for example, be wavy or zig-zagged with appropriate adaptation of the passageway openings for the separating elements in the circumferential surface of the winding roller.

It is understood that the drive mechanism 148 preferably produces a sudden movement which is concluded in fractions of a second, typically less than 0.1 seconds. This determines the duration of the separation process which in turn can be adapted to the running speed of the web.

It can be seen without further effort that the description above of special preferred forms of embodiment of the invention can be modified by those skilled in the art. The area of use and applicability of the invention is thus determined by the interpretation of the following claims in accordance with the art.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. An apparatus for carrying out a process for cutting through a material web running into a driven winding roll and for fastening a start of the following web on a winding tube, comprising:

a guide device guiding the web into the winding roll, said guide device having, a knife for cutting through the web;

a rotating element for redirection of the start of the web by the guide device onto the winding tube; and a guide channel for laying the web around the winding tube after the web has been cut by said knife;

said guide device for winding the web from a left side or a right side of the winding tube for placement of either side of said web as an outer side on said winding tube, said winding tube being driven in a corresponding one of two opposite directions of rotation; and said winding tube being concentrically enclosed by a cylindrical housing forming the guide channel including an annular space, said housing being provided with an axial intake gap for the start of the web.

2. The apparatus according to claim 1, wherein the guide device includes a driven vacuum roller, said knife including a separating knife which can be run out of a gap running axially in a circumferential surface of a casing of said vacuum roller, both sides of the gap having pivotably disposed casing shells which introduce the start of the web lifted up from a jacket cylinder of said roller, according to a running direction of the web, to the left or right sides around the guide channel.

3. The apparatus according to claim 1, wherein the cylindrical housing includes two pivotably mounted housing shells which release the winding tube in a pivoted-out state.

4. The apparatus according to claim 3, wherein a pivoting drive mechanism for the housing shells is provided.

5. The apparatus according to claim 4, wherein the pivoting drive mechanism includes linking arms hingedly connected at one of their ends to the housing shells and, at their other ends jointedly connected to one another, a pneumatic cylinder is hingedly connected.

6. The apparatus according to claim 3, wherein each of the housing shells is provided with vacuum nozzles.

7. The apparatus according to claim 3, wherein each of the housing shells is provided with blast air nozzles.

8. The apparatus according to claim 1, wherein the guide device includes a roller with a casing having an axially running slot, edges of said casing adjacent said slot having recesses therein that are sealed by casing shells which can be pivoted out and include a grid or plates running out freely in the circumferential direction toward the gap which penetrate, in the pivoted-out state, fingers which form an edge area of the intake gap of the housing on both sides and which are disposed with an offset.

9. The apparatus according to claim 8, wherein the casing shells are provided with pivoting drive mechanisms including pneumatic cylinders.

10. The apparatus according to claim 1, wherein for displacement of the intake gap, the housing is mounted pivotably about a central axis of the winding tube.

11. The apparatus according to claim 1, wherein the knife includes a plurality of individual knives fastened at equal intervals on a knife-carrying bar, said knife-carrying bar being guided in such a manner that it runs the knives out radially, moves them in the axial direction, and runs them in radially once again.

12. The apparatus according to claim 11, wherein the knife-carrying bar is provided, in the area of its ends, with rollers which run in trapezoidal guides.

13. The apparatus according to claim 11, wherein radial and axial movements of the knives are superimposed on one another.

14. The apparatus according to claim 13, wherein the knife-carrying bar is guided in curved guides formed in a circular arc.

15. The apparatus according to claim 1, wherein the knife includes a plurality of individual knives fastened at equal intervals on a knife-carrying bar, said knife-carrying bar being mounted on parallel linking arms provided with a pivoting drive mechanism, said linking arms pivoting the knives on a path formed in a semicircular arc.

16. A separating apparatus for use in a web-winding apparatus with a winding roller and devices for initial winding and final winding of a continuously running material web onto a series of winding tubes, comprising:

a separating apparatus disposed in an interior of the winding roller at a slot in a casing extending over an operating width, said separating device having a plurality of separating elements connected with one another in their movement which, to effect the separating process, are formed movably outwards in a radial direction through the casing of the winding roller and at least approximately parallel to an axis of the winding roller in an axial direction where a length of the movement of each separating element in the axial direction is chosen so that the material web is completely separated transversely.

17. An apparatus for the winding of a continuously running material web onto a series of winding tubes comprising a winding roller, at least one deflection roller, at least one separating device, and a device to wind a front end, formed on actuation of the separating device, of the running material web on a winding tube by a vacuum flow, said winding apparatus having, for bidirectional winding operation, a bell-shaped cover for initial winding, said cover enclosing the winding tube currently being initially wound onto and formed by two elongated shells, each of the shells having, near its respective movable ends, a vacuum slot extending at least approximately over a length of the winding tube, and the bell-shaped cover having devices in order to actuate one of the vacuum slots for initial winding, said separating apparatus being disposed in an interior of the winding roller.

18. The apparatus according to claim 17, wherein the winding roller has a plurality of gaps and is connected to a source of low pressure in order to hold a material web lying on the winding roller in firm contact with the winding roller.

19. The apparatus according to claim 17, wherein the shells in the closed state of the bell-shaped cover form, together with a winding tube encircled by the bell-shaped cover, an approximately annular channel for guiding a vacuum flow around the winding tube in order to guide the vacuum flow around at least approximately 270° of a circumference of the winding tube.

20. An apparatus for carrying out a process for cutting through a material web running into a driven winding roll and for fastening a start of the following web on a winding tube, comprising:

a guide device guiding the web into the winding roll, said guide device having, a cutting element for cutting through the web that includes a plurality of individual knives fastened at substantially equal intervals on a knife-carrying bar, said knife-carrying bar being guided in such a manner that it runs the knives out radially, moves them in the axial direction, and runs them in radially once again;

a rotating element for redirection of the start of the web by the guide device onto the winding tube; and a guide channel for laying the web around the winding tube after the web has been cut by said cutting element; and said guide device for winding the web from a left side or a right side of the winding tube for placement of either side of said web as an outer side on said winding tube, said winding tube being driven in a corresponding one of two opposite directions of rotation.

21. The apparatus according to claim 20, wherein the knife-carrying bar is provided, in the area of its ends, with rollers which run in trapezoidal guides.

22. The apparatus according to claim 20, wherein radial and axial movements of the knives are superimposed on one another.

23. The apparatus according to claim 22, wherein the knife-carrying bar is guided in curved guides formed in a circular arc.

24. The apparatus according to claim 20, wherein said knife-carrying bar is mounted on parallel linking arms provided with a pivoting drive mechanism, said linking arms pivoting the knives on a path formed in a semicircular arc.

* * * * *